US006935218B2

(12) United States Patent
Urvoy

(10) Patent No.: US 6,935,218 B2
(45) Date of Patent: Aug. 30, 2005

(54) WEAPON AIMING SYSTEM

(75) Inventor: Emile Urvoy, Limours (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/477,879

(22) PCT Filed: Apr. 26, 2002

(86) PCT No.: PCT/FR02/01452

§ 371 (c)(1),
(2), (4) Date: Nov. 17, 2003

(87) PCT Pub. No.: WO02/093101

PCT Pub. Date: Nov. 21, 2002

(65) Prior Publication Data

US 2004/0134339 A1 Jul. 15, 2004

(30) Foreign Application Priority Data

May 17, 2001 (FR) ..... 01 06494

(51) Int. Cl.[7] ..... F41A 25/00

(52) U.S. Cl. ..... 89/37.07; 89/41.17; 89/41.19; 89/41.01

(58) Field of Search ..... 89/36.13–36.14, 89/41.01–41.02, 41.19, 41.17, 37.07

(56) References Cited

U.S. PATENT DOCUMENTS

| | | | | | |
|---|---|---|---|---|---|
| 946,402 | A | * | 1/1910 | Schneider et al. | 89/41.19 |
| 1,353,499 | A | * | 9/1920 | Shearer | |
| 2,712,271 | A | * | 7/1955 | Wabnitz | 89/41.01 |
| 2,762,265 | A | * | 9/1956 | Arend | 89/41.02 |
| 3,772,960 | A | * | 11/1973 | Johansson | |
| 4,326,446 | A | * | 4/1982 | Magnuson | |
| 4,387,624 | A | | 6/1983 | Bjurstrom | |
| 4,599,933 | A | * | 7/1986 | Stoner | 89/37.07 |
| 4,953,443 | A | * | 9/1990 | Meier | 89/41.19 |
| 5,014,594 | A | * | 5/1991 | Muhlhausen et al. | |
| 5,048,392 | A | * | 9/1991 | Ruttgerodt et al. | 89/37.07 |
| 5,864,085 | A | * | 1/1999 | Begneu et al. | 89/37.07 |
| 6,024,007 | A | * | 2/2000 | Searle et al. | |
| 6,178,866 | B1 | * | 1/2001 | Searle et al. | 89/37.07 |
| 6,499,382 | B1 | * | 12/2002 | Lougheed et al. | 89/41.17 |
| 6,708,597 | B2 | * | 3/2004 | Meyers et al. | 89/41.19 |
| 2004/0159229 | A1 | * | 8/2004 | Urvoy | 89/41.01 |
| 2004/0200348 | A1 | * | 10/2004 | Urvoy | |

FOREIGN PATENT DOCUMENTS

| | | |
|---|---|---|
| DE | 3241 665 A1 | 5/1984 |
| EP | 0 179 387 A2 | 4/1986 |
| FR | 2 421 362 | 10/1979 |

* cited by examiner

*Primary Examiner*—Michael J. Carone
*Assistant Examiner*—L. Semunegus
(74) *Attorney, Agent, or Firm*—Oliff & Berridge, PLC

(57) ABSTRACT

The invention relates to an elevation laying system for a weapon mounted on a vehicle.

It comprises first positioning means for the weapon along a wide elevation range with respect to a first axis of rotation offset with respect to the center of gravity of the weapon, and second positioning means for the weapon connected to the first means along a narrow elevation range with respect to a second axis of rotation passing through the center of gravity of the weapon. The first axis of rotation is located to the rear of the weapon's center of gravity. The first positioning means are hinged with respect to a frame onto which the weapon is mounted around the first axis of rotation.

19 Claims, 3 Drawing Sheets

WEAPON AIMING SYSTEM

BACKGROUND OF THE INVENTION

The technical scope of the present invention is that of laying systems for a weapon that ensure its stabilisation.

When a weapon is mounted on a mobile support, that is on a moving vehicle, its laying operations become very difficult to ensure since the weapon is subject to a certain number of disturbances. Firing from such a weapon requires it to be oriented in the direction of the target despite any movement be it linear or angular of the vehicle. One particularity of a vehicle able to move at high speeds (over 50 Km/H) cross country lies in the stresses to which it subjects the weapon and its laying system and which generally correspond to a high frequency level and cover a wide spectrum.

During travelling, these disturbances may come from:

- the angular velocity of the support on which the weapon is mounted in traverse and that is located on the weapon at the motorization system,
- the linear acceleration applied to the trunnions of the weapon via the off-centring of the centre of gravity,
- the angular acceleration applied directly to the weapon by the friction appearing on the trunnions,
- by the linear acceleration applied via the trunnions onto the weapon's centre of gravity causing its dynamic strain. In particular, when the frequency of the disturbance is close to the resonance frequency of the weapon itself, the weapon's own mode amplifies the natural strait to a ratio of several tens under the effect of the acceleration in question.

Several methods and devices are known to mitigate the travel effects on the performance of a weapon.

A first method consists in measuring the disturbing angular velocity, for example using gyrometric style means and using it to control the rotational velocity of the motorization system placed between the support and the weapon. It is thus an anticipation control placed in parallel to an automatic control of the position of the weapon on an inertial reference whose efficiency is low so as to attenuate the amplitude of the angular disturbances at mean frequencies. Reference may be made, for example, to patent FR-80.21077.

Another method consists in providing motorization allowing the torque applied to the load to be controlled. This principle is used to improve the efficiency of the reduction in the effects of angular velocity disturbances. This method is suitable for low off-centring values. Reference may be made, for example, to patent U.S. Pat. No. 4,387,624.

When the off-centring between the axial position of the centre of gravity and the rotational axis increases, the performances obtained rapidly deteriorate through a combination of several mechanisms.

First of all, the off-centring of the centre of gravity increases the effect of the vertical acceleration produced (the unbalance effect) when travelling on the angular displacement of the weapon.

The increase in the motorization torque requirement caused by the dynamic torque requirement (in spite of the static equilibrating of the unbalance mass) leads in particular to the increase in inertia of the motor. The sensitivity of the system to mean frequency noises increases as a consequence, with as a corollary the necessity of increasing the filtering of all the sensors. The stabilisation performances are reduced along with the filtering of the sensors.

On certain weapon systems, functional constraints in particular related to the feeding principle of the weapon add to the off-centring of the centre of gravity of the geometric constraints that increase the friction at the trunnions with its effect on the orientation accuracy of the weapon.

Lastly, on other systems, to minimise the necessary volume at the rear and under the axis of orientation of the weapon, the assembly of this weapon requires the axis of orientation to be largely pushed back to the rear of the recoiling mass, this results in a substantial increase in the off-centring with its effect of the orientation accuracy, in particular during travel.

SUMMARY OF THE INVENTION

The aim of the present invention is to produce a laying system for a weapon mounted on a mobile carrier allowing pre-stabilising motorization to separate the motorization dimensioning need occasioned by the off-centring of the weapon from that privileging the quality of the orientation control.

The invention thus relates to an elevation laying system for a weapon, characterised in that it comprises first positioning means for the weapon along a wide elevation range with respect to a first axis of rotation offset with respect to the centre of gravity of the weapon, and second positioning means for the weapon connected to the first means along a narrow elevation range with respect to a second axis of rotation passing through the centre of gravity of the weapon.

According to one characteristic, the first axis of rotation is located to the rear of the weapon's centre of gravity.

According to another characteristic, the first positioning means are hinged with respect to a frame onto which the weapon is mounted around the first axis of rotation.

According to another characteristic, the first positioning means comprise a clamp supporting the weapon and connected to the frame and a rotation means, the first axis of rotation being positioned between said clamp and the frame.

According to yet another characteristic, the rotation means ensure the rotation of the clamp with respect to the frame.

According to yet another characteristic, the weapon is mounted able to rotate with respect to the clamp, the second positioning means ensuring the rotation of the weapon with respect to the clamp around the second axis.

According to yet another characteristic, the rotation means are constituted by a jack.

According to yet another characteristic, the second positioning means comprise a motor or back-geared motor integral with the clamp along the second axis of rotation.

According to yet another characteristic, the second positioning means comprise a jack integral with the clamp and whose rod is connected to the weapon.

According to yet another characteristic, the second positioning means comprise a jack integral with the clamp and whose rod is connected to the frame.

According to yet another characteristic, the second positioning means comprise a parallelogram able to deform and connecting the clams to the frame and an actuator integral with one branch of the parallelogram meshed with the second axis of rotation.

A first advantage of the system according to the invention lies in the respect of the organisational needs of the weapon system by displacing the hinge pin so as to respect the functional or global optimisation constraints.

Another advantage lies in the respect of the needs in absolute orientation quality to be imposed on the weapon by adopting a second joint at the centre of gravity.

Another advantage lies in the reduction of parasitic torques between the weapon and the clamp.

BRIEF DESCRIPTION OF THE DRAWINGS

Other characteristics, particulars and advantages of the invention will become more apparent following the description given hereafter by way of illustration and in reference to the appended drawings, in which.

DETAILED DESCRIPTION OF THE PREFERRED EMBODIMENT

As is apparent from the above, the invention consists in providing two motorizations of the weapon with respect to its support. A first motorization, or main motorization, allows the weapon to be roughly oriented in elevation. This motorization allows the weapon to be positioned without any constraints. A second motorization allows the orientation of the weapon to be finely adjusted taking its bearing the main motorization. The advantage of such a system lies in the fact that the range between the weapon and the clamp is limited to stabilisation errors, thereby making it simple to produce. Moreover, since the dimensioning of the second motorization is linked only to the inertia of the weapon to be oriented, efficient torque control is carried out with any specific constraints.

Figure 1:
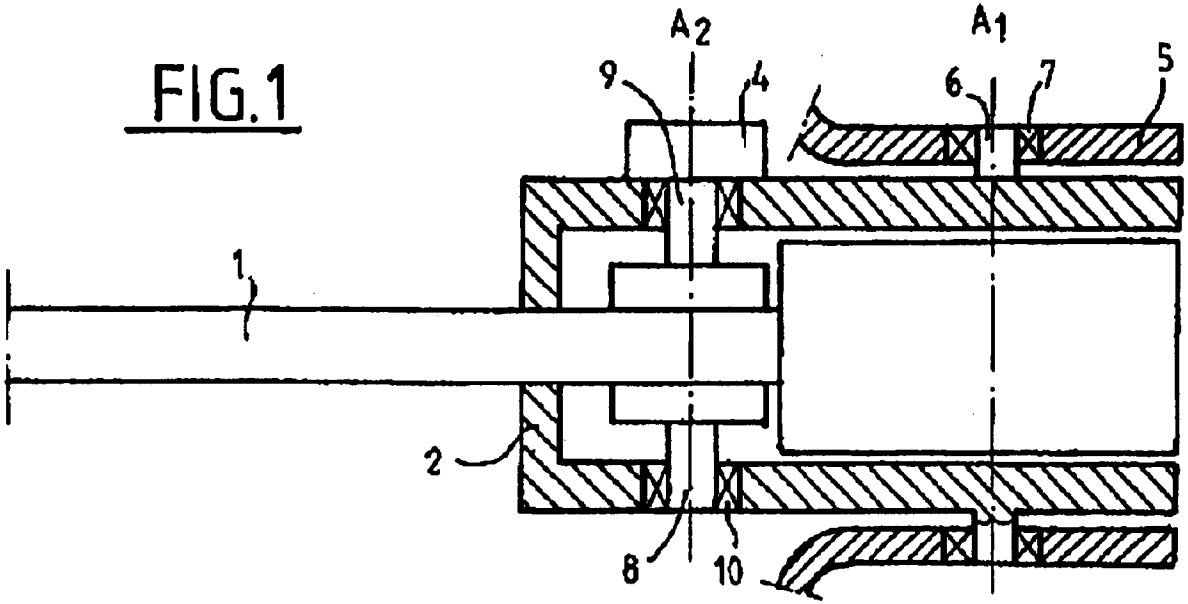
FIG. 1 is a section view of the weapon from the top passing through the axes of rotation.

FIG. 1 shows the weapon 1 to be oriented in elevation made integral with a clamp 2 itself mounted able to rotate with respect to a support 5, for example a turret, by means of trunnions 6 and bearings 7. In the Figure, we can see that the clamp 2 is in the form of a cage in which the rear part of the weapon is engaged. The weapon 1 is itself mounted able to move with respect to the clamp 2 by means of trunnions 8 connected to an actuator 4 by means of a shaft 9 and by bearings 10. The trunnions 6 and bearings 7 define the axis A1 around which the main motorization is made for a wide range and the rotation of the clamp 2, and therefore the weapon itself, with respect to the support 5. The trunnions 8 and bearings 10 define the axis A2 around which the second motorization is made for a narrow range and the rotation of the weapon with respect to the clamp. In the case shown, the actuator 4 is a motor integral with the clamp.

Figure 2:
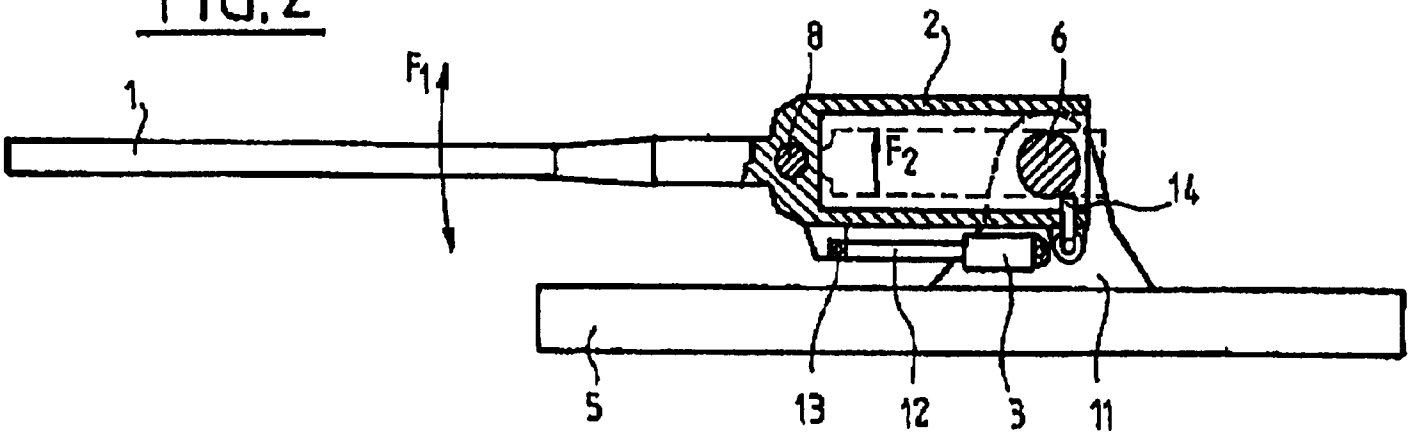
FIG. 2 is a front section view of the weapon passing through the axes of rotation.

FIG. 2 shows the weapon 1 mounted on a support 5 by means of a frame 11. The clamp 2 and trunnions 6 around which the weapon is articulated with respect to the frame 11 have been schematically represented. The clamp 2 is made to rotate using the rotation means 3 constituted by a jack whose rod 12 is integral with the clamp 2 by means of a shaft 13 and the body of the frame 11. By activating the jack 3 the clamp 2, and therefore the weapon 1, is made to revolve around the trunnions 6 to roughly orient it according to a substantial amplitude of the weapon with respect to the frame 11. This amplitude may cover a range of −10° to +60° following arrow F1. The weapon 1 is itself mounted able to revolve with respect to the clamp 2 for a low amplitude in order to finely adjust its orientation. The rotation has been schematised by arrow F2. This rotation is carried out using a jack 14 whose body is integral with the clamp 2 and the rod with the weapon. This jack 14 imparts a movement to the weapon around the trunnions 8 with respect to its supporting structure, that is the clamp. This amplitude may cover a range of around 1°.

Figure 3:
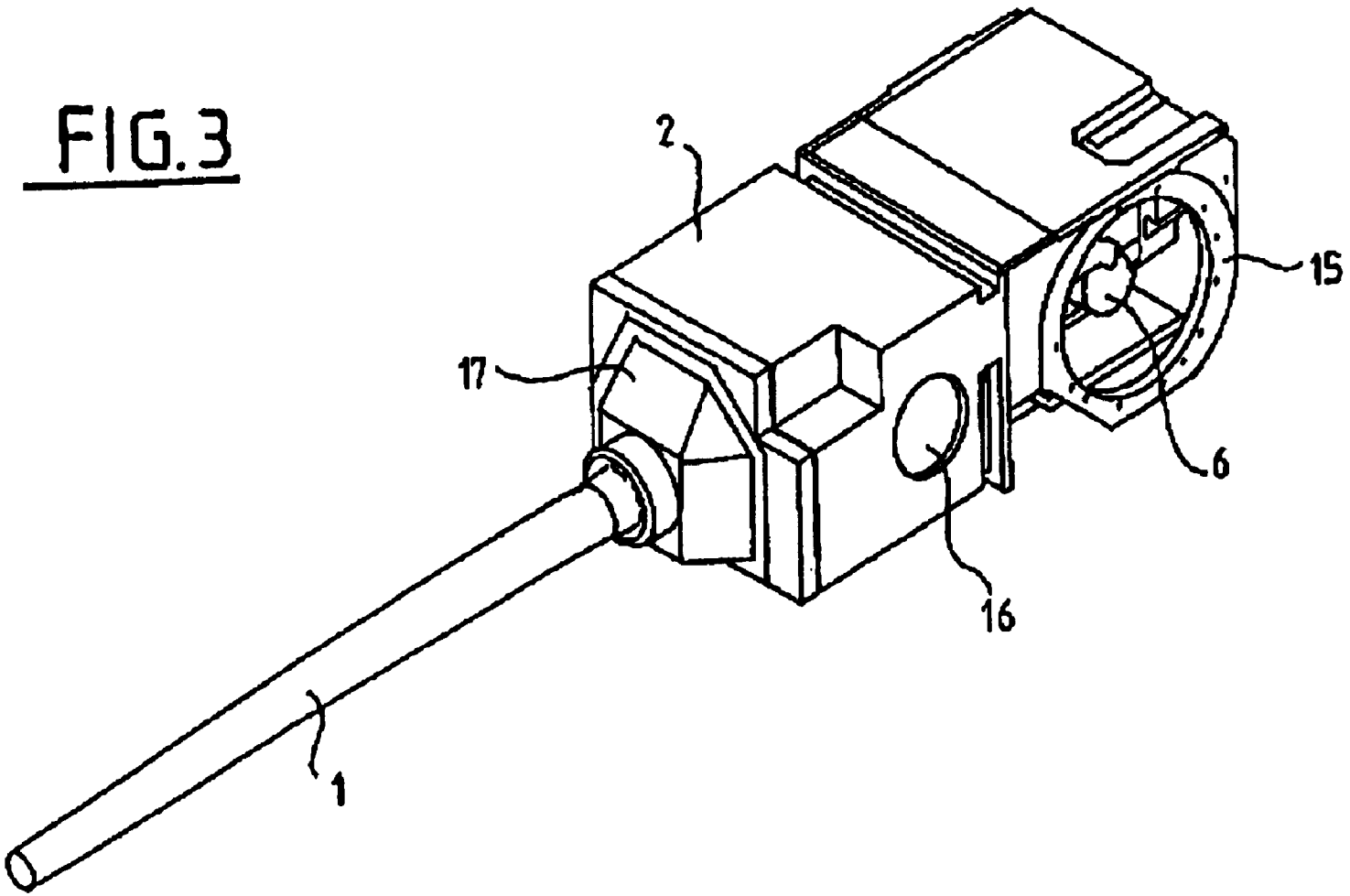
FIG. 3 is an overall view of a weapon and of its mounting clamp on the frame.

FIG. 3 shows a view of the weapon 1 equipped with the clamp 2 surrounding all the rear part of the weapon. The clamp 2 incorporates an interface 15 to link it to the frame 11, a passage-way 16 to receive the bearings 10 (not shown) receiving the trunnions 8. To the fore, the clamp is equipped with bellows 17 to close off the space between the weapon barrel and the clamp. A compact assembly is thus obtained that is ready to be mounted onto a frame in the turret of an armoured vehicle, for example a tracked vehicle.

Thus, the laying system according to the invention allows:

- a first orientation to allow the elevation range of the weapon and to respect the general functional and geometric constraints. Naturally, a classical sealing system is provided on this joint that is merely represented by a bearing 7,
- a second orientation centred on the centre of gravity of the weapon to allow limited range.

It goes without saying that the system according to the invention is integrated into a complex system allowing the weapon to be oriented according to the firing coordinates, its position and deviations with respect to an instruction to be determined, the variations in laying during travelling to be measured and any deviation measured to be corrected.

Given that the second joint is integral with the mobile clamp under the action of the first means, it is thus this first motorization and the automatic control of the axis A1 which will equally withstand the disturbances caused by the friction on the sealing rings and the vertical linear accelerations.

The sealing to be put in place at the bellows 17 is thus relatively small in dimension and the limited range does not require the installation of a friction-based system but simply a system based on flexible bellows. The bearings of this joint are also limited in dimension in that they do not have to integrate heavy functional constraints (feeding of the weapon, for example). Additionally, since the joint is centred, the acceleration disturbances do not have an effect upon the orientation of the weapon.

The range of the weapon 1 with respect to the clamp 2 is subject to two constraints:

- the range must be able to overcome any stabilisation errors of the first axis A1,
- the range must be limited by the off-centring between the weapon axis and the main trunnions 7. Indeed, the recoil load of the weapon results firstly in a disturbing torque that must be borne by the main motorization and secondly in the radial acceleration induced by the clamp on the centre of gravity of the weapon with its effect on firing in progress and/or on successive firing (for a weapon able to fire at a high rate).

In the representation in FIG. 1 an actuator 4 has been provided to ensure low amplitude range of the weapon with respect to the clamp 2. This actuator may in fact be an electrical back-geared motor whose automatic control in pass range load is sufficient and has sufficiently low rigidity. It is also possible for a hydraulic motorization to be provided constituted by a jack having a reduced range. To impose a minimum elasticity on the oil, the dead volume of each of the jack's chambers may be artificially increased by using small drained accumulators. As indicated in the aforementioned French patent, automatic pressure controlled motorization is used to automatically control the velocity of the weapon, such velocity being obtained directly by a gyrometer or via a gyrometer mounted on the clamp 2, with a derivation of the sum of the gyroscopic deviation and the relative position between the clamp 2 and the weapon 1.

Figure 4:
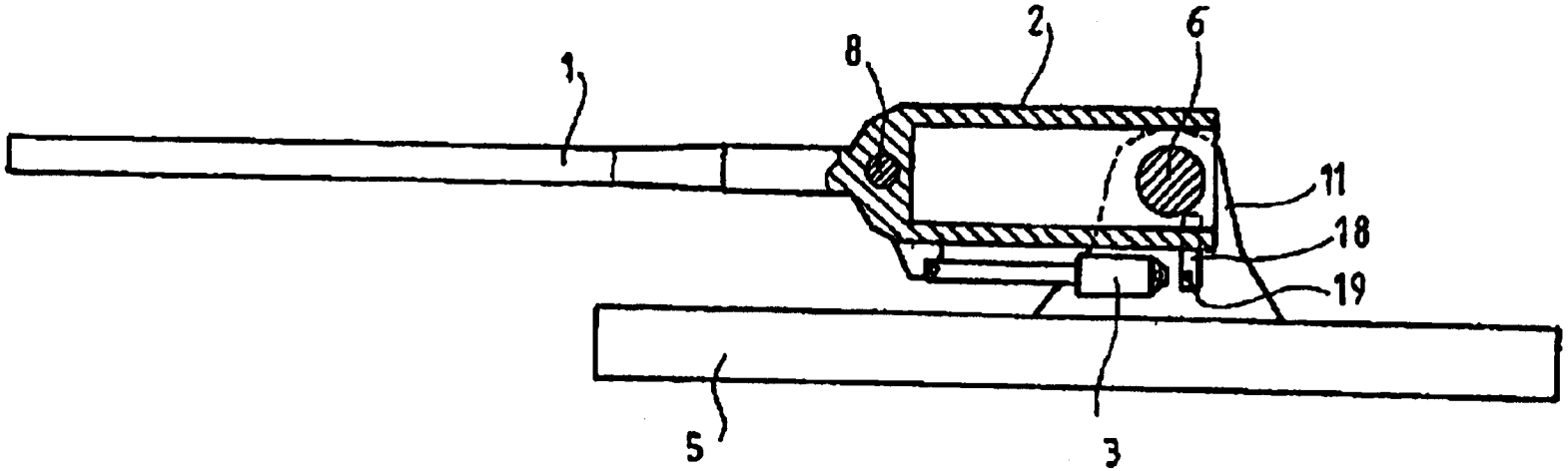
FIG. 4 is another section view of the weapon from the front.

FIG. 4 shows a secondary motorization constituted by a jack 18 whose body is integral with the frame 11 by means of a shaft 19 and whose rod is integral with the weapon. This articulated jack absorbs the relative displacements between the weapon and the frame and ensures the fine motorization of the weapon.

Figure 5:
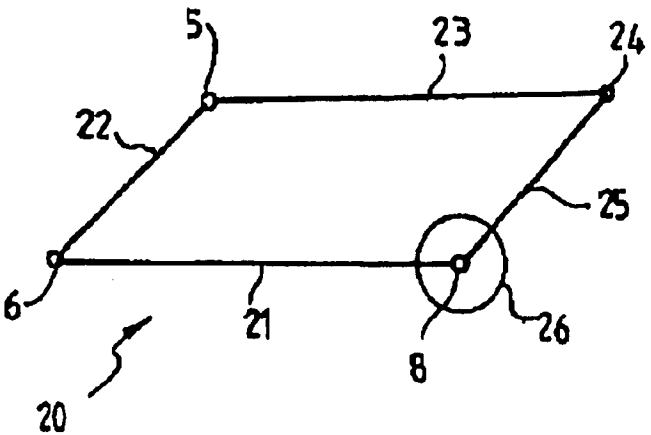
FIG. 5 shows the position of the axes of rotation of the weapon in a parallelogram.

FIG. 5 shows a secondary motorization constituted by a deformable parallelogram 20 whose arm 21 connects the trunnions 6 and 8 and whose arm 22 connects the trunnion 6 and the frame 5. This parallelogram is completed by a fourth point 24 to which the arms 23 and 25 are connected. A back-geared motor 26 integral with the trunnion 8 allows the weapon to be activated in rotation with respect to the clamp 2 bearing on the frame via the arm 25.

Generally speaking, any secondary motorization able to apply a torque to the weapon cradle in a sufficient pass range may be used.

To implement the system according to the invention a set of sensors is used:

at least one angular sensor of the clamp 2 relative to the orientation of the turret. The relative velocity of the mantlet and the turret will be obtained by derivation.

at least one relative angular position sensor between the cradle and the clamp.

at least one gyroscopic type sensor to supply the orientation of the clamp and an inertial reference allowing the line of sight to be materialised, for example. A derivation of this information will allow the clamp velocity to be known by adding it to the precession control of the gyroscope.

at least one radial acceleration sensor on the clamp, to the right of the main axis of rotation Al allowing the measurement of the linear acceleration disturbance to be known.

All of these sensors allow the operator to know firstly the reference onto which the weapon is required to be oriented and secondly the information concerning the main disturbances acting on the weapon system. Secondary sensors correspond respectively to the angular velocity of rotation of the electric motor of the main motorization and to the differential pressure between the secondary jack's chambers, the latter information corresponding directly to the torque that the secondary motorization applies to the weapon.

What is claimed is:

1. An elevation laying system for a weapon, comprising:

first positioning means for the weapon along a wide elevation range with respect to a first axis of rotation offset with respect to the centre of gravity of the weapon; and second positioning means for the weapon connected to the first positioning means along a narrow elevation range with respect to a second axis of rotation passing through the centre of gravity of the weapon, said first axis of rotation and said second axis of rotation parallel to one another at all times.

2. A laying system according to claim 1, wherein the first axis of rotation is located to the rear of the weapon's centre of gravity.

3. A laying system according to claim 1, wherein the first positioning means are hinged with respect to a frame onto which the weapon is mounted around the first axis of rotation.

4. A laying system according to claim 3, wherein the first positioning means comprise a clamp supporting the weapon and connected to the frame and a rotation means, the first axis of rotation being positioned between said clamp and the frame.

5. A laying system according to claim 4, wherein the rotation means ensure the rotation of the clamp with respect to the frame.

6. A laying system according to claim 5, wherein the weapon is mounted able to rotate with respect to the clamp, the second positioning means ensuring the rotation of the weapon with respect to the clamp around the second axis.

7. A laying system according to claim 5, wherein the rotation means are constituted by a jack.

8. A laying system according to claim 1, wherein the second positioning means comprise a motor meshed with the second axis of rotation.

9. A laying system according to claim 4, wherein the second positioning means comprise a motor or back-geared motor integral with the clamp along the second axis of rotation.

10. A laying system according to claim 1, wherein the second positioning means comprise a jack integral with the clamp and having a rod connected to the weapon.

11. A laying system according to claim 4, wherein the second positioning means comprise a jack integral with the clamp and having a rod connected to the frame.

12. A laying system according to claim 4, wherein the second positioning means comprise a parallelogram able to deform and connecting the clamp to the frame and an actuator integral with one branch of the parallelogram meshed with the second axis of rotation.

13. An elevation laying system for a weapon, comprising:

first positioning means for the weapon along a wide elevation range with respect to a first axis of rotation offset with respect to the centre of gravity of the weapon; and second positioning means for the weapon connected to the first positioning means along a narrow elevation range with respect to a second axis of rotation passing through the centre of gravity of the weapon, wherein the first positioning means are hinged with respect to a frame onto which the weapon is mounted around the first axis of rotation, and the first positioning means comprise a clamp supporting the weapon and connected to the frame and a rotation means, the first axis of rotation being positioned between the clamp and the frame.

14. A laying system according to claim 13, wherein the rotation means ensure the rotation of the clamp with respect to the frame.

15. A laying system according to claim 14, wherein the weapon is mounted able to rotate with respect to the clamp, the second positioning means ensuring the rotation of the weapon with respect to the clamp around the second axis.

16. A laying system according to claim 13, wherein the rotation means are constituted by a jack.

17. A laying system according to claim 13, wherein the second positioning means comprise a motor or back-geared motor integral with the clamp along the second axis of rotation.

18. A laying system according to claim 13, wherein the second positioning means comprise a jack integral with the clamp and having a rod connected to the frame.

19. A laying system according to claim 13, wherein the second positioning means comprise a parallelogram able to deform and connecting the clamp to the frame and an actuator integral with one branch of the parallelogram meshed with the second axis of rotation.

* * * * *